United States Patent [19]

Gould et al.

[11] 4,019,170

[45] Apr. 19, 1977

[54] ADAPTER UNIT FOR PEDESTRIAN TRAFFIC CONTROL SIGNAL

[75] Inventors: James S. Gould, Los Alamitos; Samuel Gould, Los Angeles, both of Calif.

[73] Assignee: Indicator Controls Corporation, Gardena, Calif.

[22] Filed: Dec. 10, 1975

[21] Appl. No.: 639,267

[52] U.S. Cl. ..... 340/119; 340/84; 361/331

[51] Int. Cl.[2] ..... E01F 9/00

[58] Field of Search ..... 340/44, 107, 119, 87, 340/50, 366 E; 116/63 RP; 174/52 R, 58, 59; 240/2 R; 317/101 CB, 120; 40/132 R

[56] References Cited

UNITED STATES PATENTS

| | | | |
|---|---|---|---|
| 2,793,356 | 5/1957 | Hart | 340/107 X |
| 3,085,224 | 4/1963 | Becka | 340/44 X |
| 3,101,177 | 8/1963 | Loomis et al. | 340/44 X |
| 3,564,495 | 2/1971 | Gould et al. | 340/44 |
| 3,873,969 | 3/1975 | Gould et al. | 340/44 |

*Primary Examiner*—William M. Wannisky
*Attorney, Agent, or Firm*—Keith D. Beecher

[57] ABSTRACT

An adapter unit is provided which may be easily and quickly fitted into existing pedestrian traffic control signals to adapt such signals to an assembly in which luminous gaseous tube signal elements are mounted in an enclosed capsule, or module, which, in turn, is supported within the original housing of the signal. The adapter unit of the invention comprises a signal illuminating capsule which has a tray-like configuration, and which is mounted in the cover of the traffic control signal by means of a pair of cross bars which are releasably clipped into brackets fixed to the upper and lower rear edges of the cover.

6 Claims, 7 Drawing Figures

FIG. 3
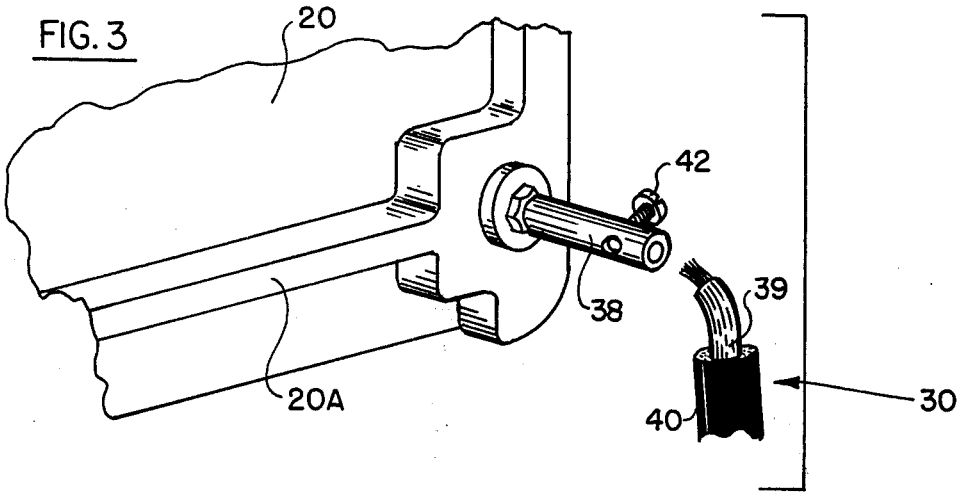
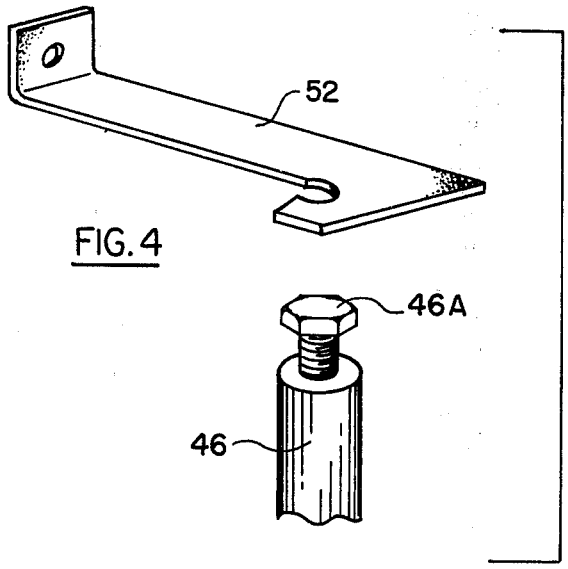
FIG. 4
FIG. 5
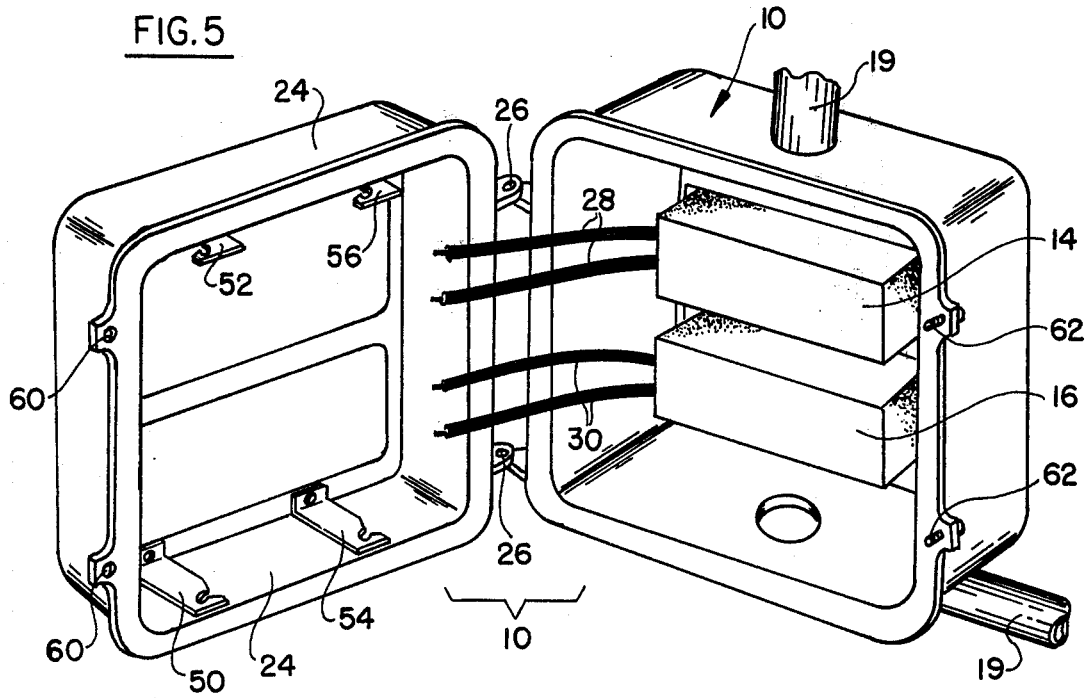

ADAPTER UNIT FOR PEDESTRIAN TRAFFIC CONTROL SIGNAL

BACKGROUND OF THE INVENTION

Pedestrian traffic control signals are provided at many crosswalks of the busier street intersections in order to direct pedestrian traffic, and to reduce pedestrian accidents. The National Safety Council originally approved a type of pedestrian traffic control signal which is energized alternately to display the word Walk and the words DONT WALK. The present standards tend to adopt DONT WALK in Portland orange and WALK in lunar white.

The words WALK and DONT WALK are formed in the usual prior art type of pedestrian traffic signal by neon or other luminous gaseous tubes which are energized at relatively high voltage by transformers mounted within the casing of the individual signal. The usual prior art signal has presented problems, both from a maintenance standpoint in the replacement of the luminous gaseous tubes, and from the standpoint of short-circuiting due to corona effects as the high voltage leads within the case absorb moisture and create discharge paths to the casing wall.

An adapter unit is described in U.S. Pat. No. 3,873,969 which issued Mar. 25, 1975 in the names of the present inventors which may be readily fitted into the housing of existing pedestrian signals of the general type described above. The adapter unit described in the patent, in one embodiment, comprises a support bracket which fits over the transformers within the casing, and which is held in a press-fit within the casing so that there is no need for holes to be drilled, or for screws or bolts to be used in mounting the adapter unit of the patent.

The adapter unit disclosed in the patent also includes a socket support which is affixed to the bracket and which includes a plurality of electrical sockets mounted on the support. The high voltage windings of the transformers in the casing are connected by relatively short leads to the sockets, and these leads may be spaced at relatively large distances away from the walls of the casing so that there is no chance of corona effects occurring. In the adapter unit described in the patent, the neon tubes which illuminate the signal are mounted in an enclosed module which has electrodes extending out from its rear side, and which are received in the sockets supported in the casing, as described above.

The adapter unit of the present invention is somewhat simpler than the adapter unit described in the U.S. Pat. No. 3,873,969, in that the enclosed capsule containing the neon tubes is supported within the cover of the casing by two simple bars extending across the rear face of the capsule in spaced, parallel relationship, and which are clipped into appropriate brackets mounted in the cover at the top and bottom sides thereof. The electrodes which extend through the rear wall of the capsule, unlike the adapter unit described in the aforesaid patent, are directly connected to cables from the transformer. The cables are preferably enclosed in rubber sleeves, or tubes, to minimize corona effects.

The structure of the invention simplifies the installation of the adapter unit into the pedestrian traffic control signal, and it also eliminates the need for relatively long high voltage leads between the transformers in the signal casing and the neon tubes within the capsule, which leads are subject to moisture absorption and resulting corona effects. For servicing purposes, the cover of the signal is opened, the supporting cross bars are unclipped from their brackets, the high voltage leads are disconnected from the capsule, and the entire capsule is easily removed, and may be replaced by a new one. The capsule itself is enclosed by a front planar lens element on which the words DONT and WALK are inscribed.

The adapter unit of the invention is also advantageous in that the enclosed capsule may be conveniently shipped with a minimum incidence of breakage of the fragile neon tubes within the capsule. The capsule itself is rugged and strong, and is not susceptible to fracture.

A feature of the invention is that the adapter unit may be easily installed in existing pedestrian control signals with a minimum of effort, and with a minimum of expense. When so installed, the signal is easy to service, and is not susceptible to corona effects.

BRIEF DESCRIPTION OF THE DRAWINGS

FIG. 3 is an enlarged detailed representation of one of the electrodes on the rear face of the capsule of FIG. 2, within the area designated by the arc 3—3 in FIG. 2;

FIG. 4 is a perspective representation of a bracket into which one of the cross bars is clipped, and is an enlarged representation of the area designated by the arc 4—4 in FIG. 2;

FIG. 5 is a view like FIG. 2, but with the capsule removed from the cover frame;

DETAILED DESCRIPTION OF THE ILLUSTRATED EMBODIMENT

Figure 1:
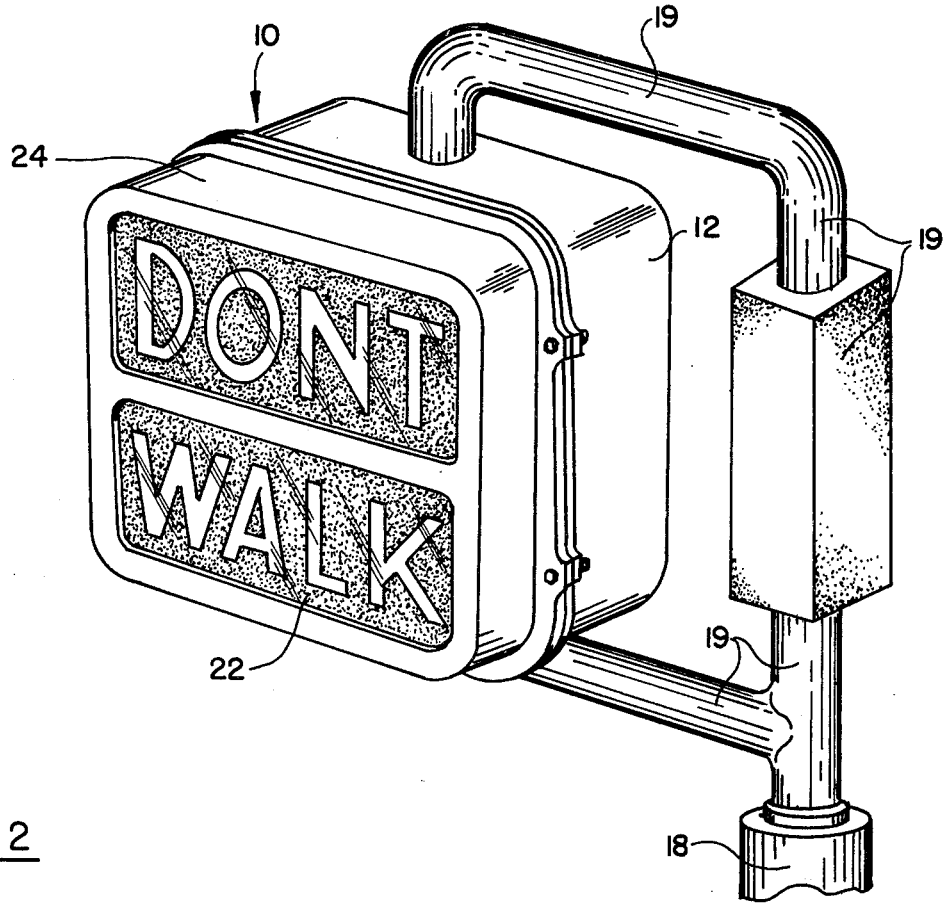
FIG. 1 is a perspective representation of a pedestrian control signal of the type under consideration, and which may incorporate the adapter unit of the invention.
Figure 2:
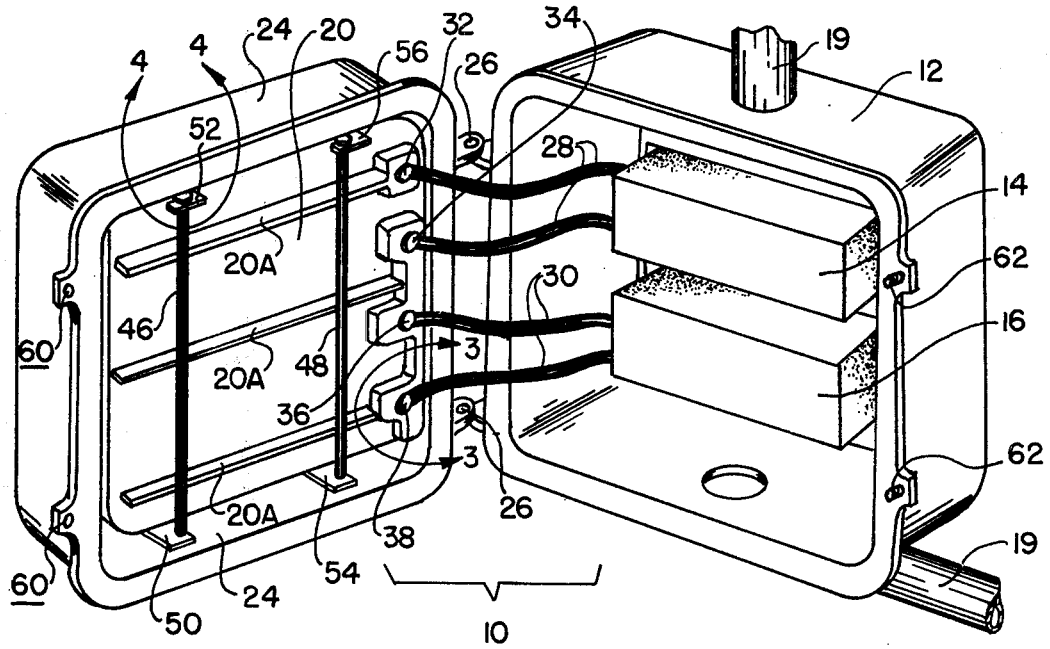
FIG. 2 is a perspective representation of the signal of FIG.1 in an open condition, to reveal the rear of the enclosed capsule supported in the cover of the signal, and also showing the manner in which the capsule is removably retained within the cover frame.

The pedestrian traffic control signal illustrated in FIGS. 1, 2 and 5 is designated generally as 10. The signal 10 includes a casing 12 in which a pair of transformers 14 and 16 are mounted. The casing 12 is supported, for example, on a pole 18 by means of a C-shaped bracket 19 which is mounted on the top of the pole. The electrically energized luminous gaseous tubes of the unit of FIGS. 1 and 2 are mounted, for example, in an enclosed capsule designated 20. The capsule 20 is supported in a frame-like cover 24. The cover 24 is hinged to the casing 12 by means, for example, of appropriate hinges 26.

The capsule 20 contains a first neon tube which, when energized, illuminates both the DONT and WALK inscriptions on a lens element 22 which forms the front plate of the capsule; and it also contains a second neon tube which when energized illuminates only the WALK portion of the lens 22.

The tubes in the capsule are connected to the transformers 14 and 16 by respective leads 28 and 30. When the transformer 14 is energized, a high voltage appears across the leads 28 to energize the first neon tube in the module 20 so that the words DONT WALK may be illuminated on the lens 22. When the transformer 16 is energized, a high voltage appears across the leads 30 to energize the second neon illumination tube in the module 20 so that the word WALK may be illuminated.

The capsule 20 has four electrodes 32, 34. 36 and 38 extending through its rear wall, each of which may have the construction shown in FIG. 3. The electrodes are threaded onto four threaded posts which extend outwardly from the rear face of the capsule 20. The leads 28 connect to the electrodes 32 and 34 which are, in turn, connected through two of the threaded posts to one of the tubes in the capsule; and the leads 30 connect to the electrodes 36 and 38, as shown in FIG. 2, which, in turn, are connected through the remaining two threaded posts to the other tube in the capsule.

The electrodes 32, 34, 36 and 38, as shown in FIG. 3 are each formed of a rigid tubular member of electrically conductive material which receives the end of the corresponding cable, with the cable held in place by means of a set screw 42. When the cables are connected to the electrodes, the rubber sleeves 40 may be moved right down over the respective electrodes adjacent the insulating material at the base thereof.

Each of the leads 28 and 30 is surrounded by an internal insulating layer, and an outer insulating layer in the form of a thick rubber sleeve, such as designated respectively as 39 and 40 in FIG. 3 to minimize corona effects. The internal diameter of each of the electrodes 32, 34, 36 and 38 corresponds to the outer diameter of layer 39 and, as shown in FIG. 3, only the outer layer 40 is stripped, and the lead with its inner layer 39 is inserted into the electrode. The screw 42 is then tightened to pierce the outer layer, and to make a good screw-to-wire contact without breaking the individual strands. The remaining layer 39 also provides additional strain relief.

The remaining layer 39 also serves to contain the individual strands of wire in the lead so as to facilitate electrical contact with the screw and yet provide resilient restraint on relocation of the individual strands. The remaining layer 39 also eliminates the need for a hole in the electrode opposite to screw 42. The remaining layer 39, after being pierced by screw 42 flows around the thread of the screw thereby providing a locknut effect to hold the screw tight in the electrode in the presence of vibrations. The electrodes 32, 34, 36 and 38 are located adjacent the hinges 26, so that the leads 28 and 30 may be relatively short, and yet permit the cover 24 to be opened to its full extent.

Since the other end of each of the leads 20 and 30 is potted in the transformers 14 and 16, there is no tendency for the leads to twist, and when the leads are locked in the electrodes 32, 34, 36, 38 they prevent the electrodes from twisting. The placement of the rubber sleeves 40 down over the individual electrodes, and over the screws 42, also serves to hold the screws tightly in place in the presence of vibrations. The foregoing features are extremely important due to the high voltages at the connections between the leads and the electrodes, and they serve to prevent arcing between the electrodes.

The capsule 20 is supported within the cover frame by a pair of bars 46 and 48. The bars 46 and 48 are releasably clipped into brackets 50, 52, 54 and 56 mounted at the top and bottom of the cover frame. As shown in FIG. 4, the brackets are shaped so that the heads of the bars, such as the head 46*a* of bar 46 may be clipped into the bracket securely to hold the bars in the brackets, but yet to permit the bars easily to be released. The bars extend across the ribs 20A which are formed in the rear wall of the module. The capsule 20, itself, may be made of an appropriate plastic material, and, as mentioned above, the planar lens 22 is supported in the front of the capsule, so as to enclose and protect the neon tubes within the capsule.

The cover 24 is held in a closed position across the face of casing 12 by means of appropriate screws 62 which are threaded into tapped holes 60 through the flanges surrounding the cover and casing.

Figure 6:
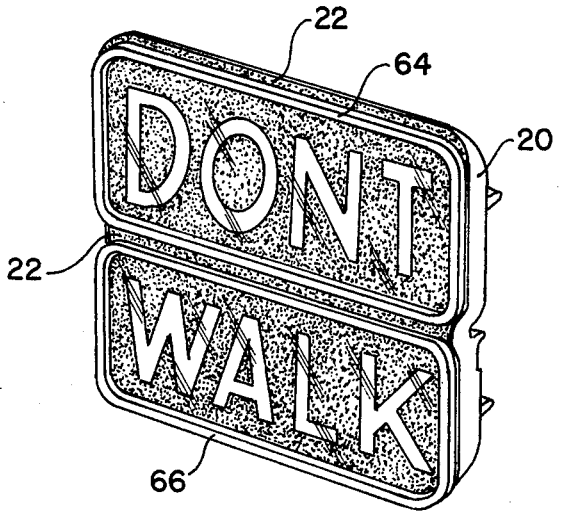
FIG. 6 is a front perspective representation of the capsule.
Figure 7:
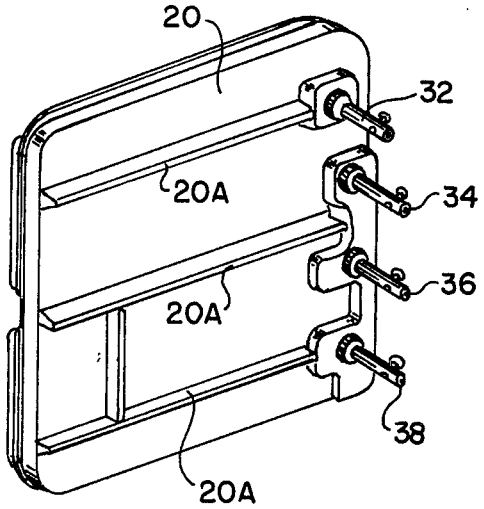
FIG. 7 is a rear perspective representation of the capsule.

As best shown in FIG. 6, the DONT portion of the lens 22 is surrounded by a resilient rubber-like gasket 64, and the WALK portion of the lens 22 is surrounded by a resilient rubber-like gasket 66. These gaskets provide a degree of resiliency to the capsule, as they bear against the front of the frame-like cover 24, so that the bars 46 and 48 may securely hold the capsule within the cover as they press against the ribs 20A on the rear face of the capsule to force the gaskets 64 and 66 against the front rims of the cover frame.

The invention provides, therefore, an improved adapter unit for a pedestrian traffic control signal which is relatively simple and inexpensive in its construction, and which may be easily installed in existing pedestrian signals. As described, the adapter unit of the invention not only facilitates the shipment of the fragile neon tubes, but it also eliminates the long high voltage leads within the casing of the signal so that corona effects and short-circuiting is minimized. The adapter unit of the invention also facilitates subsequent servicing of the signal, since in the event of a neon tube becomes burned out, it is merely necessary to disconnect and remove the entire capsule and replace it with a new one.

It will be appreciated that although a particular embodiment of the invention has been shown and described, modifications may be made. It is intended in the claims to cover the modifications which come within the spirit and scope of the invention.

What is claimed is:

1. In combination: a pedestrian traffic control signal including a casing and a frame-like cover hinged to the casing, and at least one transformer mounted in said casing; a signal illuminating capsule having a tray-like configuration mounted in said cover, said capsule having a planar lens member enclosing the front face thereof, and having electrodes mounted on the rear face thereof; electrical leads connected to said electrodes and to the transformer to establish electrical connection with the transformer; a plurality of brackets affixed to said cover at the edges thereof; and the ends of at least one bar releasably clipped into said brackets extending across and bearing against the rear face of the capsule to retain the capsule in said cover.

2. The combination defined in claim 1, in which said lens member has the words DONT and WALK inscribed thereon one above the other, and which includes a first resilient flange member mounted on the front face of said lens and surrounding the word DONT, and a second resilient flange member mounted on the front face of said lens and surrounding the word WALK, said resilient flange members being pressed against the front rim of the cover when the capsule is held in place by said bar.

3. The combination defined in claim 2, in which said cover has an open front with an intermediate cross bar extending across the pen front between the words DONT and WALK, and in which the cover also has a rim surrounding he open front, the rim and cross bar engaging said resilient flanges when the capsule is held in place in the cover.

4. The combination defined in claim 1, and which includes a first pair of said brackets affixed to the top of said cover in spaced relationship, and a second pair of said brackets affixed to the bottom of said cover in spaced relationship, and a pair of said bars releasably clipped into respective ones of said brackets and extending across the rear face of the capsule in spaced and parallel relationship.

5. The combination defined in claim 1, in which each of said electrodes extends outwardly from the rear face of the capsule adjacent to the edge of said cover which is hinged to the casing, and each of said electrodes has a tubular end portion for receiving the corresponding electric lead and a set screw extending radially into the tubular end portion thereof.

6. The combination defined in claim 5, in which each of the electrical leads has an insulating layer surrounding multi-strand electrical wires, the insulating layer being received in the tubular end portion of the corresponding electrode to be pierced by the corresponding set screw, and which includes a plurality of rubber sleeves respectively surrounding the electric leads and extending down over the respective electrodes.

* * * * *